US007027609B2

(12) United States Patent
Kudo et al.

(10) Patent No.: US 7,027,609 B2
(45) Date of Patent: Apr. 11, 2006

(54) DIAPHRAGM FOR SPEAKERS

(75) Inventors: Yoshimi Kudo, Yamagata (JP); Junichi Sato, Yamagata (JP); Akira Otake, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 648 days.

(21) Appl. No.: 09/895,197

(22) Filed: Jul. 2, 2001

(65) Prior Publication Data

US 2002/0025059 A1 Feb. 28, 2002

(30) Foreign Application Priority Data

Aug. 31, 2000 (JP) ..... P. 2000-264129

(51) Int. Cl.
*H04R 25/00* (2006.01)

(52) U.S. Cl. ..... 381/423; 381/426; 381/432

(58) Field of Classification Search ..... 381/423, 381/424, 426, 427, 428, 429, 432, 353, 354, 381/409, 410; 181/157, 163–169
See application file for complete search history.

(56) References Cited

U.S. PATENT DOCUMENTS

| | | | | | |
|---|---|---|---|---|---|
| 1,713,210 | A | * | 5/1929 | Barton | 381/428 |
| 2,295,483 | A | * | 9/1942 | Knowles | 381/404 |
| 3,200,900 | A | | 8/1965 | Brittain | |
| 3,424,873 | A | * | 1/1969 | Walsh | 381/346 |
| 4,118,605 | A | * | 10/1978 | Kobayashi | 381/407 |
| 4,275,278 | A | * | 6/1981 | Sakurai et al. | 381/426 |
| 4,395,597 | A | * | 7/1983 | Suzuki et al. | 181/170 |
| 4,478,309 | A | * | 10/1984 | Kawamura et al. | 181/167 |
| 5,594,805 | A | * | 1/1997 | Sakamoto et al. | 381/412 |
| 5,933,512 | A | * | 8/1999 | Tamura | 381/424 |

FOREIGN PATENT DOCUMENTS

| | | | |
|---|---|---|---|
| DE | 945 568 | C | 7/1956 |
| FR | 2 031 634 | A | 11/1970 |
| GB | 410 778 | A | 5/1934 |

* cited by examiner

*Primary Examiner*—Huyen Le
(74) *Attorney, Agent, or Firm*—Sughrue Mion, PLLC

(57) ABSTRACT

A diaphragm for a speaker comprises a metal cone 2 and a paper auxiliary cone 4 bonded integrally to the center portion of the metal cone 2.

7 Claims, 2 Drawing Sheets

DIAPHRAGM FOR SPEAKERS

BACKGROUND OF THE INVENTION

1. Field of the Invention

The present invention relates to a diaphragm for speakers made of metal.

2. Description of the Related Art

Generally, some diaphragms for speakers are made of metal such as aluminum or the like.

Since such a metal diaphragm for speakers enjoys high rigidity, it has advantages that the high limit frequency can be improved and the stability in quality is ensured.

However, it has a disadvantage that when the diaphragm is made of metal, the sound pressure frequency characteristics can be extended to the high-pitch tone region since the Young's module of the diaphragm is very high, but a sharp peak may be generated because the internal loss of the sound in the diaphragm is low, and thus it is difficult to apply the metal diaphragm to the midrange-woofer speakers in which smooth attenuation without a peak is desirable.

SUMMARY OF THE INVENTION

It is an object of the present invention to solve the aforementioned problem of the metal diaphragm as described above that the resonance at the high limit frequency is too sharp to obtain a flat frequency, and to provide a metal diaphragm for a speaker that is applicable to the midrange-woofer speakers.

In order to achieve the object above, according to a first aspect of the present invention, there is provided a diaphragm for a speaker comprising a metal diaphragm body, and an auxiliary diaphragm made of paper that can be bonded integrally to a part of the diaphragm body.

In the diaphragm according to the first aspect of the invention, when it is mounted to the speaker and produces an output of sound corresponding to the acoustic signal by being vibrated by the magnetic circuit, relatively smooth attenuation can be realized without extending the sound pressure frequency characteristics too much to the high-pitch tone region since paper that is bonded integrally to the metal diaphragm body to form an auxiliary diaphragm for constructing the diaphragm together with a diaphragm body has far lower Young's module than meals such as aluminum and has an internal loss.

Therefore, according to the first aspect of the invention, the metal diaphragm in which resonance at high limit frequency is controlled to obtain a flat frequency characteristic and which is applicable to the midrange-woofer speakers is provided.

In the diaphragm of the present invention, preferably, the auxiliary diaphragm is formed in dimensions that covers only the center portion of the diaphragm body, whereby a diaphragm having a flat frequency characteristic while taking advantage of merits that the metal diaphragm for speakers is provided.

In the diaphragm of the present invention, preferably, recessed portions toward the center thereof are formed at a plurality of locations along the outer periphery of the auxiliary diaphragm.

In general, there is a problem in that when the area of the metal diaphragm body, on which the paper auxiliary diaphragm is to be bonded, increases, the high limit frequency is lowered, but in contrast thereto, the peak becomes larger, and in addition, the level of the output sound pressure is lowered due to increase in weight of the diaphragm. However, according to the diaphragm of the present invention, since the generating line of the auxiliary diaphragm is set to vary in part by the recessed portions formed on the outer periphery of the auxiliary diaphragm, increase in the area of the diaphragm body covered by the auxiliary diaphragm and in weight is controlled, and thus the high limit frequency and the peak thereof are set to the desired values so that a flat frequency characteristic is obtained.

In the diaphragm of the present invention, preferably, an odd number of recess portions are formed at regular angular intervals along the outer periphery of the auxiliary diaphragm, whereby the dividing vibration of the diaphragm is controlled.

In the diaphragm of the present invention, preferably, the outer configuration and the area of the auxiliary diaphragm are set based on the high limit frequency of the diaphragm to which the auxiliary diaphragm is bonded, and the length of the generating line of the auxiliary diaphragm is set depending on how the weight, the high limit frequency, and the extent of its peak are controlled considering the continuity between the midrange speaker and the tweeter speaker.

In the diaphragm according to the present invention, preferably, a through hole for inserting the connecting cable is formed at the portion where the diaphragm body and the auxiliary diaphragm are overlapped, whereby the feeder portion of the diaphragm for inserting the connecting cable to connect with the voice coil can be made of paper of the auxiliary diaphragm, and thus insulation of the connecting cable of the diaphragm can easily be made.

In the diaphragm of the present invention, preferably, a cylindrical portion to which the voice coil bobbin of the speaker is connected is integrally formed at the center of the auxiliary diaphragm, where by the diaphragm can easily be mounted to the speaker, and insulation between the metal diaphragm body and the voice coil can easily be made.

In the diaphragm of the present invention, preferably, the auxiliary diaphragm is formed by manufacturing of paper, whereby the auxiliary diaphragm can be made easily and uniformly.

DETAILED DESCRIPTION OF THE PRESENT INVENTION

Figure 1:
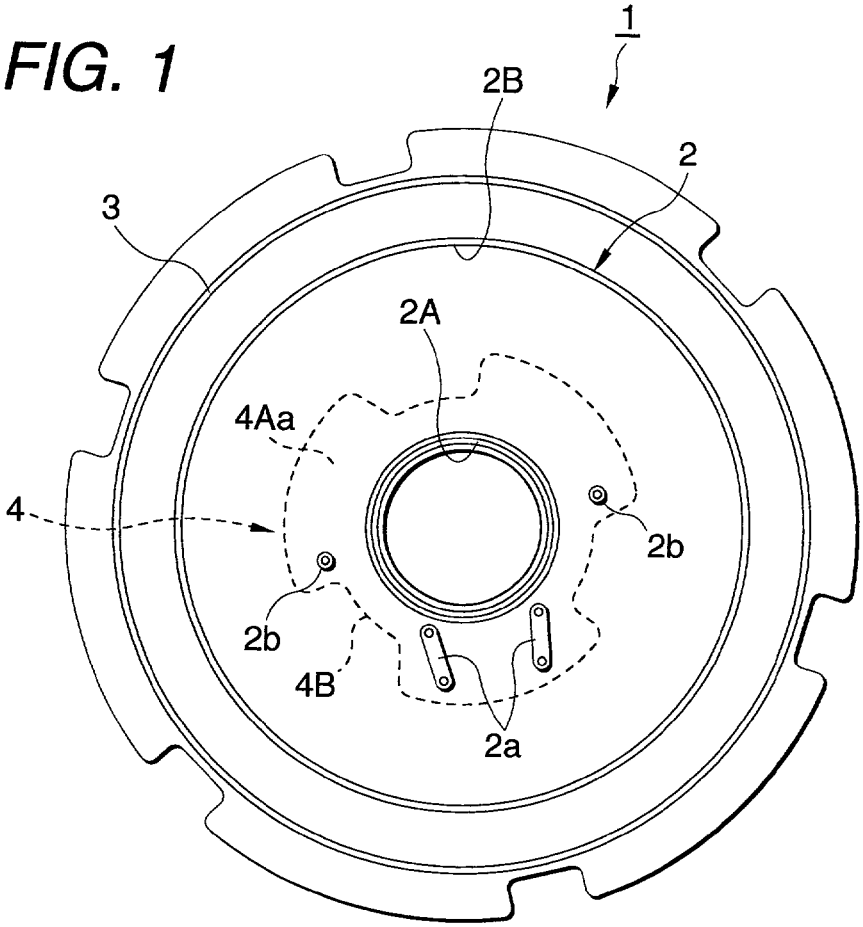
FIG. 1 is a plan view showing a diaphragm according to an embodiment of the present invention.

Referring now to the drawings, the present invention will be described in detail with reference to the accompanying drawings.

Figure 2:
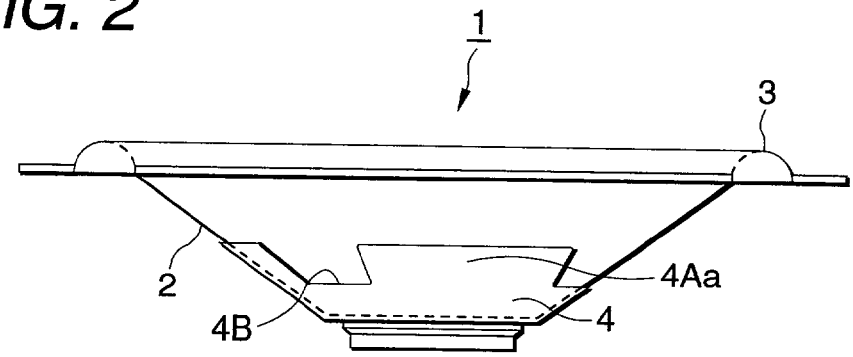
FIG. 2 is a side view of the diaphragm.

FIG. 1 is a plan view showing a diaphragm for a speaker according to an embodiment of the present invention, and FIG. 2 is a side view thereof.

In FIGS. 1 and 2, the diaphragm 1 comprises a metal corn 2 made of light metal such as aluminum or the like generally into the shape of a truncated cone, a rubber edge 3 formed into a ring shape, and a paper auxiliary cone 4.

The metal cone 2 is opened at the tip end surface of the truncated cone being larger in diameter (upper end surface in FIG. 2), and at the rear end surface thereof being smaller in diameter (lower end surface in FIG. 2) respectively, and a pair of elongated holes 2*a* extending generally in parallel with the generating line of the truncated cone are formed at a distance at the position of the conical surface near the opening 2A at the rear end, and a pair of round holes 2*b* are formed symmetrically with the elongated holes 2*a* interposed in the circumferential direction.

The rubber edge 3 is fixed on the outer peripheral edge of the opening 2B on the topside of the metal cone 2 by being bonded by adhesive agent along the whole periphery thereof.

Figure 3:
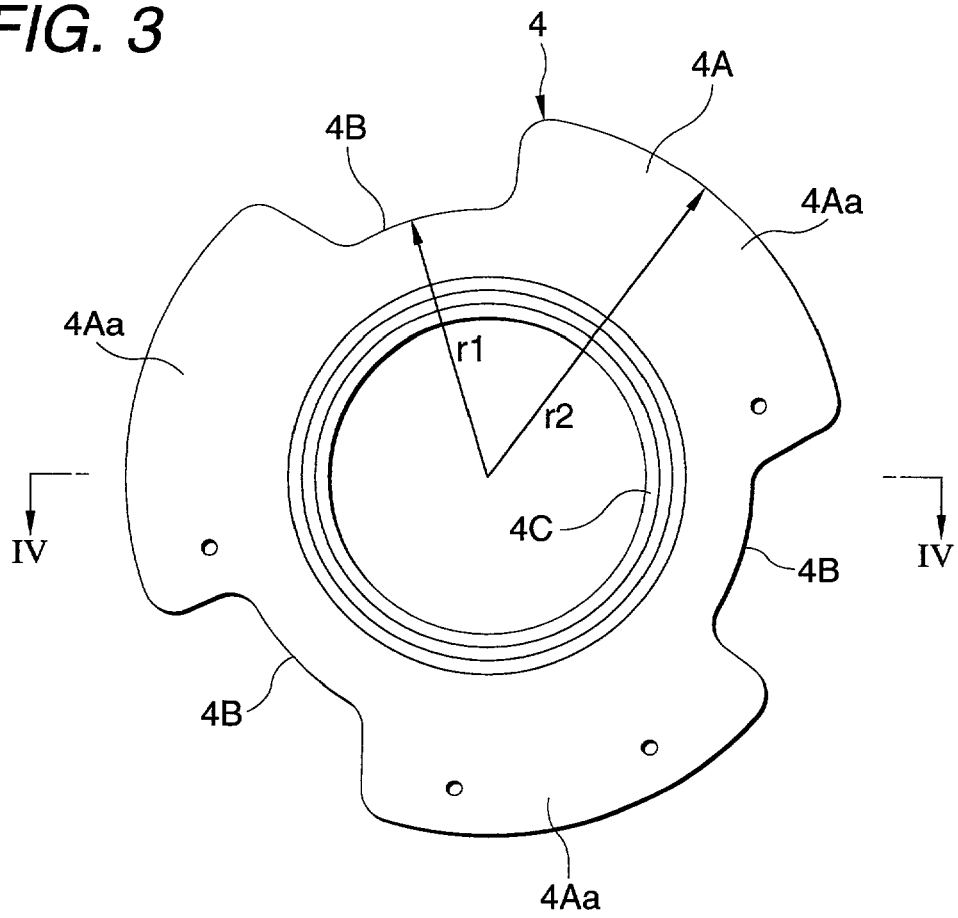
FIG. 3 is a plan view of an auxiliary cone of the diaphragm.
Figure 4:
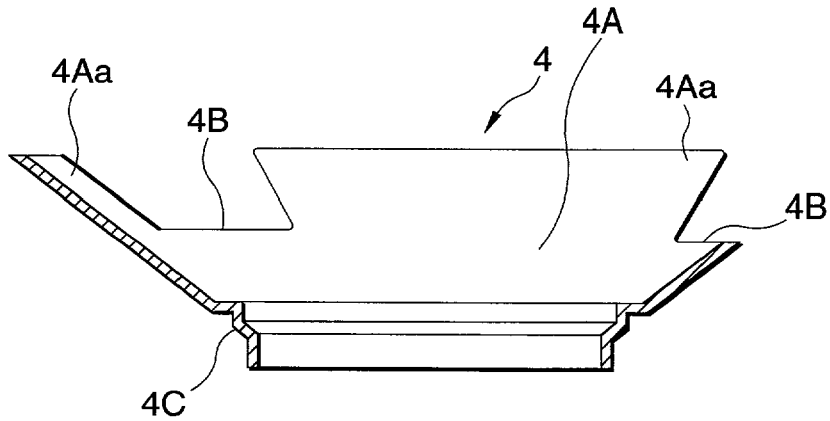
FIG. 4 is a cross sectional view taken along a line IV—IV in FIG. 3.

The auxiliary cone 4 is formed by manufacturing of paper, and, as shown in FIGS. 3 and 4, the main body portion 4A has the shape of a truncated cone formed in such a manner that the conical surface thereof is the same tilt angle as the conical surface of the metal cone 2, and the diameter of the rear end surface (lower end surface in FIG. 4) is almost the same as that of the opening 2A of the metal cone 2.

On the conical surface of the main body portion 4A, there are formed recessed portions 4B that are recessed from the tip edge toward the rear end at a plurality of locations (three locations in the example shown in the figure).

These recessed portions 4B are formed on the conical surface of the main body portion 4A at regular angular intervals, and each has generally the shape of a fan extending in the circumferential direction of the main body portion 4A.

Therefore, the length of the generating line r1 at the portion of the main body portion 4A where these recessed portions 4B are formed is shorter than the length of the generating line r2 at the portion 4A*a* that is located between the recessed portions 4B formed at the tip portion of the main body portion 4A (hereinafter referred to as wing portion).

At the rear end of the main body portion 4A, there is formed integrally a cylindrical portion 4C opened through so as to be continued from the conical surface of the main body portion 4A.

This auxiliary cone 4 is fixed on the outer peripheral surface of the rear end portion of the metal cone 2 by being bonded with an adhesive agent.

At this time, the auxiliary cone 4 is positioned with respect to the metal cone 2 in such a manner that the elongated holes 2*a* and the round holes 2*b* on the metal cone 2 are facing toward the wing portions 4A*a* of the auxiliary cone 4 respectively.

The diaphragm 1 described above constructs a speaker in a state in which the voice oil bobbin (not shown) is connected to the cylindrical portion 4C of the auxiliary cone 4.

An acoustic output corresponding to the acoustic signal is produced by the diaphragm 1 being vibrated by the magnetic circuit of the speaker. At this time, since paper forming the auxiliary cone 4 being integrally fixed to the metal cone 2 and constituting the diaphragm together with the metal cone 2 has far lower Young's module than metals such as aluminum and has an internal loss, relatively smooth attenuation is realized without extending the sound pressure frequency characteristics to the high-pitch tone region too mach.

There is recognized problem in that when the area of the metal cone 2 on which the paper auxiliary cone 4 is bonded increases, the high limit frequency is lowered, but in contrast thereto, the peak becomes larger, and in addition, the level of the output sound pressure is lowered to increase in weight of the diaphragm.

Therefore, the diaphragm 1 is formed in such a manner that the generating line is set to vary in part (r1 and r2) by recessed portions 4B formed on the tips of the auxiliary cone 4, so that increase in area of the metal cone 2 on which the paper auxiliary cone 4 is bonded as well as increase in weight is controlled.

In this way, the values of the high limit frequency and the peak of the diaphragm 1 are set to the desired value, so that a flat frequency characteristic can be realized.

When taking the dividing vibration of the diaphragm into consideration, the number of the recessed portion 4B (the number of the wing portions 4A*a*) is preferably odd numbers (3 or 5), and the difference between the generating lines r1 and r2 is set depending on how the weight, the high limit frequency, and the extent of its peak are controlled considering the continuity between the midrange speaker and the tweeter speaker.

The diaphragm 1 is connected to the voice coil by a tinsel code (connecting cable) for conducting a current of acoustic signal to the voice coil (not shown) wound around the voice coil bobbin to be connected to the cylindrical portion 4C of the auxiliary cone 4 passing through the portion facing toward the elongated holes 2*a* or the round holes 2*b* of the metal cone 2 of the auxiliary cone 4.

As a consequent, insulation of the tinsel code at the feeder portion of the speaker is realized by the paper auxiliary cone 4.

What is claimed is:

1. A diaphragm for a speaker comprising:

a diaphragm body made of metal; and an auxiliary diaphragm made of paper, the auxiliary diaphragm integrally bonded to a first part of the diaphragm body;

wherein the auxiliary diaphragm is formed to cover only the center portion of the diaphragm body, wherein the diaphragm body includes a second part in an area except for the center portion, where the second part is not covered with the auxiliary diaphragm, and wherein an area of the auxiliary diaphragm is less than an area of the diaphragm body.

2. The diaphragm according to claim 1, wherein the auxiliary diaphragm is formed by manufacturing of paper.

3. A diaphragm for a speaker comprising:

a diaphragm body made of metal; and an auxiliary diaphragm made of paper, the auxiliary diaphragm integrally bonded to a part of the diaphragm body;

wherein a plurality of portions recessed toward the center of the diaphragm body are formed at a plurality of locations along the outer periphery of the auxiliary diaphragm.

4. The diaphragm according to claim 3, wherein the plurality of portions recessed is odd in number, and formed at regular angular intervals along the outer periphery of the auxiliary diaphragm.

5. A diaphragm for a speaker comprising:

a diaphragm body made of metal; and an auxiliary diaphragm made of paper, the auxiliary diaphragm integrally bonded to a part of the diaphragm body;

wherein the outer configuration and the area of the auxiliary diaphragm are set based on the high limit frequency of the diaphragm to which the auxiliary diaphragm is bonded, and wherein the diaphragm body includes a second part in an area except for the center portion, where the second part is not covered with the auxiliary diaphragm.

6. A diaphragm for a speaker comprising:

a diaphragm body made of metal; and an auxiliary diaphragm made of paper, the auxiliary diaphragm integrally bonded to a part of the diaphragm body;

wherein a through hole for inserting a connecting cable is formed at a portion where the diaphragm body and the auxiliary diaphragm are overlapped, whereby a feeder portion of the diaphragm for inserting the connecting cable to connect with a voice coil can be formed of paper of the auxiliary diaphragm, and wherein the diaphragm body includes a second part in an area except for the center portion, where the second part is not covered with the auxiliary diaphragm.

7. A diaphragm for a speaker comprising:

a diaphragm body made of metal; and an auxiliary diaphragm made of paper, the auxiliary diaphragm integrally bonded to a part of the diaphragm body;

wherein a cylindrical portion to which a voice coil bobbin of a speaker is connected is integrally formed at the center of the auxiliary diaphragm, and wherein the diaphragm body includes a second part in an area except for the center portion, where the second part is not covered with the auxiliary diaphragm.

* * * * *